US005477669A

United States Patent [19]

Phillips et al.

[11] Patent Number: 5,477,669

[45] Date of Patent: Dec. 26, 1995

[54] PROCESS FOR STRETCHING STAPLE FIBERS AND STAPLE FIBERS PRODUCED THEREBY

[75] Inventors: David G. Phillips, Belmont; John J. Warner, Jan Juc, both of Australia

[73] Assignee: Commonwealth Scientific & Industrial Research Organisation, Campbell A.C.T., Australia

[21] Appl. No.: 239,371

[22] Filed: May 6, 1994

Related U.S. Application Data

[62] Division of Ser. No. 834,313, Feb. 14, 1992, Pat. No. 5,365,720.

[30] Foreign Application Priority Data

Aug. 17, 1989 [AU] Australia ..... PJ 5825

[51] Int. Cl.[6] ..... D02J 1/22; D01H 5/28

[52] U.S. Cl. ..... 57/310; 28/240; 28/246; 57/252; 57/282; 57/287; 57/288; 57/290; 57/292; 57/296

[58] Field of Search ..... 57/252, 253, 254, 57/257, 282, 284, 287, 288, 290, 292, 295, 296, 310, 332, 334, 335, 341, 344; 28/240, 243, 244, 245, 246

[56] References Cited

U.S. PATENT DOCUMENTS

| | | | |
|---|---|---|---|
| 1,960,426 | 5/1934 | Zundorf | 117/16 |
| 2,387,058 | 10/1945 | Cerny | 57/310 |
| 2,936,569 | 5/1960 | Mull | 57/310 |
| 3,152,436 | 10/1964 | Dudzik et al. | 57/240 |
| 3,152,436 | 10/1964 | Dudzik et al. | 57/157 |
| 3,247,569 | 4/1966 | Gliksmann et al. | 57/294 X |
| 3,299,486 | 1/1967 | Meyers et al. | 57/292 |
| 3,369,281 | 2/1968 | Edlich et al. | 57/292 |
| 3,377,163 | 4/1968 | Hamalainen et al. | 57/292 |
| 3,778,991 | 12/1973 | Brummer | 57/344 |
| 3,803,826 | 4/1974 | Ishizawa et al. | 57/284 |
| 3,854,177 | 12/1974 | Breen et al. | 28/257 |
| 4,112,668 | 9/1978 | Spiller | 57/310 X |
| 4,700,538 | 10/1987 | Varga et al. | 57/90 |
| 4,961,307 | 10/1990 | Cook | 57/310 |
| 5,092,117 | 3/1992 | Paivinen et al. | 57/293 |

FOREIGN PATENT DOCUMENTS

| | | | |
|---|---|---|---|
| 470817 | 5/1972 | Australia . | |
| 2138734 | 5/1973 | France . | |
| 2746771 | 4/1979 | Germany | 57/252 |
| 40-6158463 | 6/1994 | Japan | 57/288 |
| 1189994 | 4/1970 | United Kingdom . | |
| 1196419 | 6/1970 | United Kingdom . | |
| 9102835 | 3/1991 | WIPO | 57/344 |

OTHER PUBLICATIONS

"Stretch- Mercerization of Cotton Fibers, Part II: Fabric Properties", Y. K. Kim, et al., Textile Research Journal, Jun. 1984, pp. 370–377.

"Stretch Mercerization of Cotton Fibers, Part I: Fiber and Yarn Properties", Y. K. Kim, et al., Textile Research Journal, May, 1984, pp. 325–330.

"Stretch Mercerization of Cotton Fibers: Parts I and II" By Kim et al, pp. 325–330 and 370–377, Sep. 1, 1983.

*Primary Examiner*—William Stryjewski

*Attorney, Agent, or Firm*—Sugnrue, Mion, Zinn, Macpeak & Seas

[57] ABSTRACT

A process for stretching natural staple fibers to reduce the diameter includes the steps of treating a substantially untwisted traveling assembly of natural fibers to plasticize the natural fibers, twisting the traveling assembly sufficiently to substantially prevent drafting of the assembly during subsequent stretching, subsequently stretching the twisted assembly and setting the stretch. Staple fibers having reduced diameters are provided as a result of the stretching process.

13 Claims, 2 Drawing Sheets

PROCESS FOR STRETCHING STAPLE FIBERS AND STAPLE FIBERS PRODUCED THEREBY

This is a divisional of application Ser. No. 07/834,313 filed Feb. 14, 1992, which is now U.S. Pat. No. 5,365,720, granted Nov. 22, 1994.

TECHNICAL FIELD

This invention relates to the stretching of staple fibres and has particular, although not exclusive application to the stretching of wool fibres to reduce their diameter, increase their length and modify their degree of lustre.

BACKGROUND ART

In order to increase the market demand for wool during the Spring through Summer season, it would be desirable to increase the availability of products made from fine yarns and also to introduce some modification to their surface appearance, such as degree of lustre. Traditionally it has been necessary to use very fine wools of diameter less than 18 microns to enable fine yarns to be spun, and modification of surface appearance has required additional chemical treatment to that normally used. The chemical methods used to modify the surface appearance are degradative and result in loss of material. Some thinning of the fibre can be achieved in this way but typically a 5% change in diameter, say one micron, requires a 10% loss of material.

An alternative approach, at least in theory, is to stretch fibres so that their diameter is reduced to less than 18 microns. However, this approach has remained in the realm of theory and a successful commercial process is yet to be devised.

Attempts to stretch the fibres in an untwisted assembly such as a sliver, have to date required uneconomic and complex machinery: the fibres must be gripped substantially continuously or at intervals of about 50 to 70 mm over a substantial distance in order to achieve a residence time adequate to ensure setting of the stretch.

An example of this approach is described in British patent 1,189,994. The untwisted assembly is passed through an array of alternately oppositely laterally moving fibre grip devices. However, grip devices are required at 50 to 70 mm intervals and a treatment machine some 30 to 40 m long would be required to achieve an adequate residence time. Another technique has been described by Kim et al in Textile Research Journal, May 1984 at 325 and June 1984 at 370, in connection with the stretch mercerization of cotton fibres in roving form. This apparatus consists of a series of closely spaced drive rollers gradually increasing in diameter. Idler rollers were placed on top of the drive rollers and the roving was passed successively under the bottom rollers and over the top rollers. This arrangement could be adapted to treat a wool roving but a very large number of rollers would be required to achieve an adequate residence time if productivity at a commercial level is to be achieved.

British patent 1,196,419 proposes inserting twist into a sliver of staple fibres and then stretching the sliver. The twist increases the frictional engagement between the fibres to ensure that stretching of the fibres and not drafting of the sliver occurs. The method and apparatus described in this British patent require a device for inserting real twist upstream of a stretching arrangement comprising two longitudinally extending pairs of rollers about which the twisted sliver is wrapped and an untwisting device downstream of the stretching arrangement. In the apparatus of this patent the input twist insertion and output twist removal rates will be different and thus complex mechanical arrangements will be required to correlate the twist insertion and twist removal rates. If the twist removal is not exact, some residual twist will remain which will cause difficulties in further processing the sliver. Furthermore the insertion of real twist limits the apparatus to a batch mode of operation because the supply ball or wound assembly of sliver at the input end of the apparatus must itself be rotated to insert the twist. Productivity is therefore limited by the need to load a fresh supply ball or wound assembly of the sliver ready for the next run after the previous ball or assembly has been unwound. Although automation of such a batch system of processing to provide a continuous throughput system is conceivable, it would require further complex machinery at the input end thereby detracting from the commercial viability of the apparatus.

British patent 1,196,419 also discloses that a twist factor of between 600 to 1000 is required for performing the method. At such a high twist factor the sliver may snap when stretched before substantial stretch occurs given that the breaking strength of fibres steadily decreases as the twist factor is increased beyond a figure of about 150. Also such highly twisted slivers would be prone to "snarling" or self entanglement and therefore difficult to control.

DISCLOSURE OF THE INVENTION

It is an object of this invention to provide a process and apparatus for stretching staple fibres to reduce their diameter and increase their length. It is a further object to provide such a process and apparatus which may be operated on a continuous basis and yet not entail undue complexity.

These objects are achieved in essence by treating an untwisted assembly of the fibres, such as a sliver or roving prior to drafting and spinning,, and employing false twist to provide the required grip of the fibres as the assembly is stretched substantially without being drafted and then treated to set the stretch. It has been discovered that the employment of false twist allows realization of the invention using much lower twist factors than those which the prior art indicates as being necessary, and the design of machinery which is not unduly complex and has a high throughput.

The invention accordingly provides a process for stretching staple fibres, for example wool fibres, to reduce their diameter, comprising treating a substantially untwisted travelling assembly of fibres to plasticize the fibres, twisting the travelling assembly sufficiently to substantially prevent drafting of the assembly when it is stretched, stretching the twisted assembly and setting the stretch; wherein the twist applied to the assembly is false twist which is imparted while the assembly is being stretched and the stretch set.

The invention further provides apparatus for stretching staple fibres, for example wool fibres, to reduce their diameter, comprising means to apply twist to a substantially untwisted travelling assembly of suitably treated fibres, means to impart stretch to the twisted assembly .and means to set the stretch; wherein the twist applying means comprises means to apply false twist to the travelling assembly while it is being stretched and the stretch set.

The twisting means may comprise a pair of spaced twist blocks, for example, provided by the nips of pairs of contra-rotating rollers, and between them one or more arrays of driven pulleys about which the travelling assembly of fibres is successively wound, the or each array being rotatable about a longitudinal axis corresponding to the direction of travel of the assembly of fibres through the apparatus. The stretching means advantageously comprises two successive such rotating arrays of pulleys wherein thee pulleys of the downstream array are driven at a speed substantially greater than the pulleys of the upstream array. In order to achieve sufficient grip the pulleys advantageously contain a vee-groove with a curved base in their circumference, into which the twisted assembly of fibres fits. The spacing between the arrays along the travelling assembly is preferably as small as possible and indeed the two arrays may be mounted on a single rotatable frame. However the two arrays may be mounted on separate rotatable frames and if so, these frames need not be closely spaced in the longitudinal direction of travel.

Preferably, the arrangement is such that the twist factor of the fibre assembly is increased following said stretching and while the stretch is being set.

The stretching of the fibre assembly may typically include the steps known per se of first plasticizing the fibres, for example of wool, by immersion in a suitable solution and pre-heating the wetted assembly before it reaches the arrays of pulleys rotating at different speeds. (The term "plasticizing" means treating the fibres to render them suitable for stretching.) In the apparatus, means may then be provided to wet the assembly upstream of the first of said twist blocks and further means may be provided to apply said heating between the first twist block and the first rotating array of pulleys.

Said setting of the stretch may be effected by means known per se, viz passing the travelling assembly through a steam setting chamber. The degree of stability achieved at this stage may vary and will depend on both the setting conditions and on the fibre pretreatment (i.e. plasticizing) conditions. Thus the stretch may be only partially set in the fibres at this stage.

Preferably, the untwisted assembly recovered from the apparatus of the invention may be treated with a suitable reagent to further stabilize the stretch and so preclude shrinking during subsequent heat treatments. With wool fibres, this may comprise a simple oxidative treatment, for example with hydrogen peroxide. It is to be appreciated that stabilization can be achieved with the use of other oxidizing agents or by the use of crosslinking agents, for example formaldehyde.

BRIEF DESCRIPTION OF DRAWINGS

The invention will now b,e further described, by way of example only, with reference to the accompanying drawings, in which.

BEST MODE FOR CARRYING OUT THE INVENTION

Figure 1:
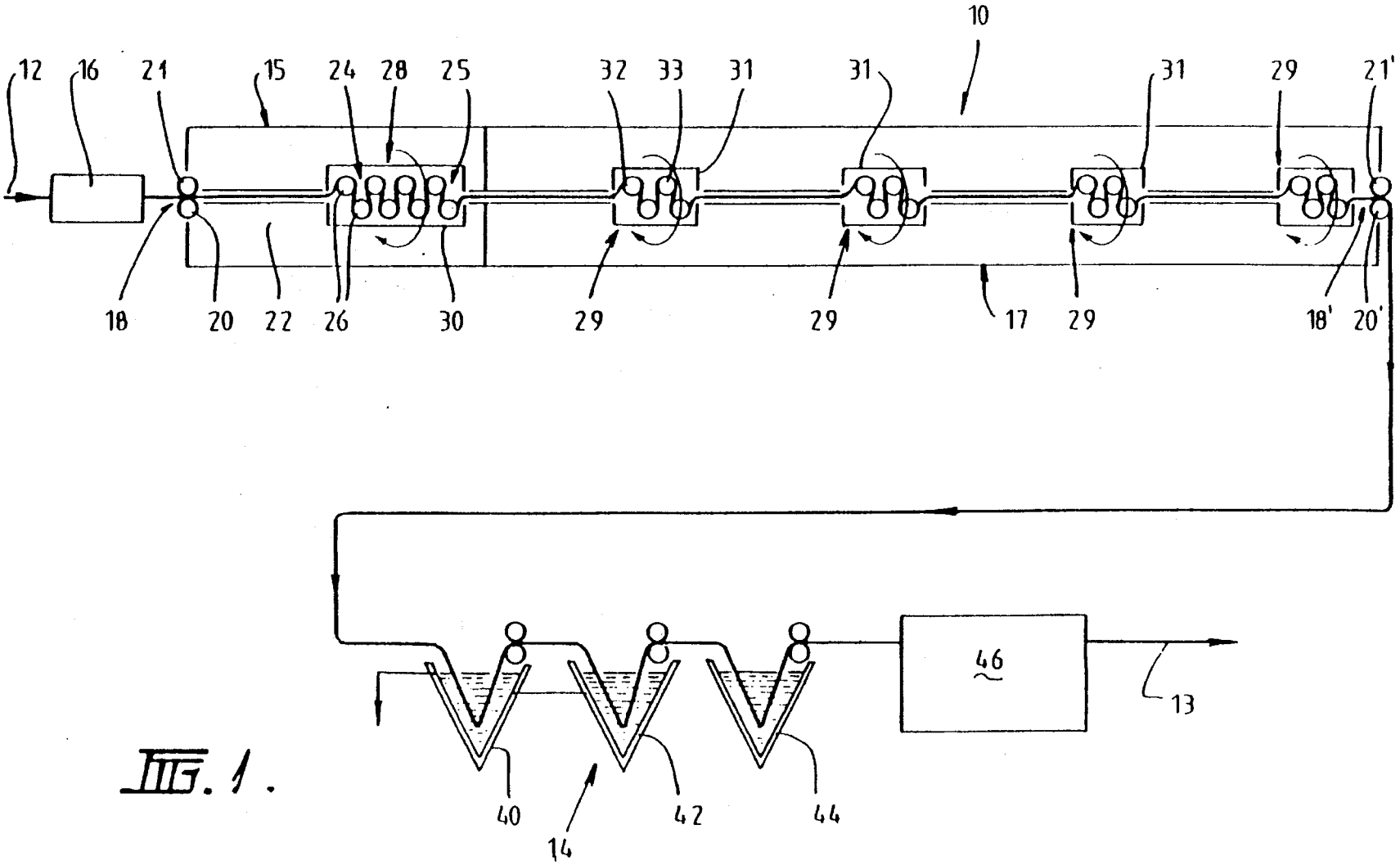
FIG. 1 is a diagrammatic representation of the principal elements of an embodiment of apparatus for stretching wool fibres.

With reference to FIG. 1, a substantially untwisted assembly 12 of fibres is drawn through apparatus 10 for stretching the fibres of the assembly and through a post treatment unit 14 for further stabilising the stretched fibres. The assembly 12 may typically comprise several wool slivers or rovings which have not yet been drafted and spun and may thus have a typical linear density in the range 50 to 110 g/m, although fibre assemblies having linear densities outside this range may be employed. The assembly 13 which emerges from unit 14 is still substantially untwisted but may have a reduced linear density and be travelling at a higher speed. In a convenient application of the invention, assembly 13 would be thereafter drafted and spun into yarn. The assembly of fibres, 12 or 13, will hereinafter be referred to as sliver.

Sliver 12 is first wetted in a bath 16 with a suitable plasticizing agent capable of increasing the concentration of mercaptide anions in proteinaceous fibres, preferably sodium bisulphite, preferably in the range 1 to 75 g/l, containing wetting agent, preferably in the range 0.25–1 g/l. Although the most effective agents are sodium, ammonium and potassium sulphite, bisulphite and meta-bisulphite, it will be appreciated that simple alkali's and alkali salts as well as sodium or ammonium thioglycollate may also be suitable. The wetted sliver then passes into a pre-heating and stretching chamber 15 via a twist blocking nip 18 defined by a pair of contra-rotating rollers 20, 21. After traversing a zone 22 in which the sliver is steam heated, the sliver is passed to a twisting/stretching module 28 in which the sliver is successively wound about each pulley of an array of eight pulleys 26 arranged in successive groups of four, 24, 25, as shown. Pulleys 26 are preferably made of stainless steel and are arranged to maximize the total length of the sliver that is gripped.

Pulleys 26 are driven and mounted within a cabinet 30 which is rotatable about the sliver axis to apply a twist to the sliver through heating zone 22 to twist blocking nip 18. In addition, the pulleys of the second, downstream, set 25 are driven at a speed about double the speed of the pulleys of the first, upstream, set 24; provided the twist factor is sufficient and the grip on the sliver by the pulleys 26 is adequate, the sliver will be extended between the last pulley of set 24 and the first pulley of set 25. It is found, in accordance with the invention, that the twist applied to the sliver provides the required transverse grip of the fibres to ensure that the sliver substantially does not draft between the two sets of pulleys but that the fibres themselves are stretched.

Although pulley arrays 24 and 25 are shown as mounted in the one cabinet 30, it is not essential that this be the case. The stretching arrays of pulleys could be mounted on separate frames, the pulleys of the downstream array on one frame being driven at a higher speed than the pulleys of the upstream array on another frame, and the frames being rotated about the longitudinal axis corresponding to the direction of travel of the sliver through he apparatus.

In a first example it is found that, for a sliver 12 of linear density 68.3 g/m travelling at a speed of 13.2 m per minute through bath 16, a twist factor in zone 22 of 120 gives satisfactory results. Twist factor is defined as the product of twist (turns per meter) and the square root of linear density (g/m). To achieve this twist factor of 120, cabinet 30 was rotated at 170 rpm and the resultant linear density of the sliver in zone 22 was 73.6 g/m. In a second example, for a sliver 12 of linear density 100 g/m travelling at a speed of 3 m per minute through bath 16, a twist factor in zone 22 of 180 gives satisfactory results. To achieve this twist factor, cabinet 30 was rotated at 49 rpm and the resultant linear density of the sliver in zone 22 was 110 g/m. It is considered that in most cases the twist factor will need to be at least 100 but preferably not more than 300.

It is further found that if the pulleys of set 25 are driven at twice the speed of the pulleys of set 24, the resultant sliver extension of 100% will produce a fibre stretch of the order of 60%.

Once the twisted and stretched sliver emerges from cabinet 30, it is necessary to steam treat the sliver for an adequate time while holding the twist so that the stretch is permanently or partially set in the fibres. In this regard permanent setting implies a high degree of stability of the fibres to release in boiling water after one hour, for example, a degree of stability of more than 95% It is surprisingly found that, whereas the experience with setting wet wool fibres in yarns was that a steam treatment residence time of 10 to 20 minutes was necessary, in the present process a residence time of the order of 2 minutes is sufficient. To this end, the stretched assembly of fibres continues to travel through a steam treatment chamber 17. The twist is maintained during this traversal by four twisting modules 29 comprising further sets 32 of four pulleys 33 which grip the sliver and are driven at a speed approximately equal to the set of pulleys 25. Desirably, the twist factor is set at a somewhat higher level than in zone 22, for example at 200, by rotating the cabinets 31 mounting the pulley arrays 32 in relation to the first example above, at about 750 rpm. For the second example, a higher twist factor of 200 may be obtained by rotating the cabinets 31 mounting the pulley arrays 32 at about 170 rpm. The level of set for the second example was 96%. In a third example, a partial setting of the fibres of 88% was effected with a sliver of linear density 90 g/m travelling at 6 m/min through bath 16. Lesser degrees of setting may be provided by varying the plasticizing treatment conditions and the steam setting times.

On emerging from the last of cabinets 31, the sliver passes through a second twist blocking nip 18' defined by contra-rotating rollers 20', 21'. It will be understood that the twist applied by the rotating pulley sets was false twist and that the travelling sliver will emerge from twist blocking nip 18' in a substantially untwisted condition. This sliver is directed to post-treatment unit 14 in which it is typically twice rinsed with water at 40, 42 and then subjected to an oxidative treatment by being passed through a bath 44 of hydrogen peroxide solution, in the range 0.2% to 5% w/v, preferably 1% w/v. Alternatively, extended rinsing in hot water (85° C.) may suffice to achieve this effect. The treated sliver is passed through a final drier 46 from which it emerges as sliver 13 comprising an assembly of fibres which are stretched and of reduced diameter relative to the fibres of sliver 12.

It has been observed that the illustrated arrangement was effective to reduce 20 to 21 micron fibres in sliver 12 to 16 to 17 micron ultrafine fibres in sliver 13. Typically the mean fibre length is increased from 65 mm in sliver 12 to 95 mm in sliver 13. Coarser fibres may also be stretched using the invention with, for example, the diameter of 25 micron wool fibres being reduced to 20 micron and 32 micron wool fibres being reduced to 25 micron. The invention is also applicable to other proteinaceous animal fibres. For example 35 micron mohair has been reduced to 28 micron. Cashmere fibres have also been reduced in diameter according to the invention. It has been further observed that surprisingly the emergent sliver 13 exhibits a significantly increased degree of lustre. Also, the process of the invention works on dyed as well as undyed,fibres.

Figure 2:
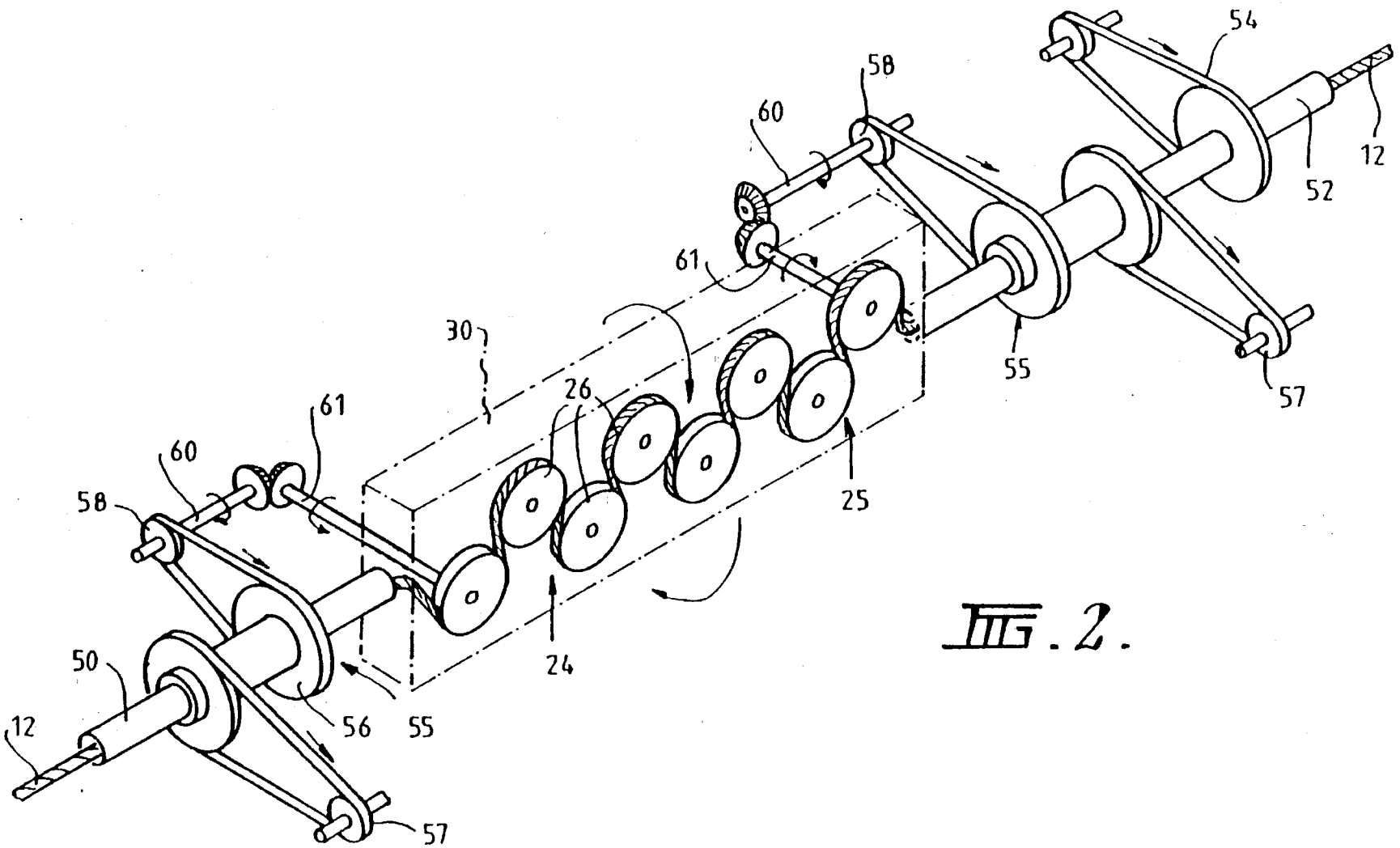
FIG. 2 is a schematic isometric view of the twisting and stretching module of the apparatus of FIG. 1.

FIG. 2 illustrates schematically a suitable mechanical arrangement for the twisting/stretching module 28. The wetted sliver 12 passes axially through tubular input and output shafts 50, 52 rotatably mounting cabinet 30 in suitable bearings (not shown). Between these shafts 50, 52 the sliver traverses the interior of cabinet 30 and is wound around the successive pulleys 26 of the two pulley sets 24, 25. Output shaft 52, and therefore cabinet 30 and its contained pulleys, are rotated by drive 54. Each of the pulley sets 24, 25 is provided with a similar pulley drive train 55. Each pulley drive train 55 includes a gear or pulley 56 rotated on shaft 50, 52 by an external drive 57. A planetary gear or pulley 58 in engagement with gear or pulley 56 revolves with cabinet 30 and rotates the pulleys of its respective set via bevel coupled shafts 60, 61 or other right angled gear set. Typically, the shaft 61 will directly drive the outermost pulley of each set and the others will be drivingly coupled in a suitable gear train.

Twisting modules 29 are of similar though less complex mechanical design to module 28.

Those skilled in the art will appreciate that the invention described herein is susceptible to variations and modifications other than those specifically described. For example, the invention may be applied to stretch the fibres in a yarn, in which case the yarn is subjected to the steps of the process or passed through the apparatus. It is to be understood that the invention includes all such variations and modifications which fall within its spirit and scope.

We claim:

1. A process for stretching natural staple fibers to reduce their diameter comprising treating a substantially untwisted travelling assembly of natural fibers to plasticize the natural fibers, twisting the treated travelling assembly to apply sufficient false twist to the assembly to substantially prevent drafting of the assembly during subsequent stretching, subsequently stretching the twisted assembly and setting the stretch; wherein the false twist is present in the assembly during stretching and subsequent setting.

2. A process as claimed in claim 1 wherein the fibers are plasticized by treatment with an agent capable of increasing the concentration of mercaptide anions in proteinaceous fibers.

3. A process as claimed in claim 2 wherein the plasticizing agent is a sulphite.

4. A process as claimed in claim 3 wherein the plasticizing agent is sodium bisulphite.

5. A process as claimed in claim 1 wherein the stretch is only partially set.

6. A process as claimed in claim 1 including a treatment to stabilize the fibers after the stretch is set.

7. A process as claimed in claim 6 wherein the stabilizing treatment includes treating the fibers with hydrogen peroxide.

8. A process as claimed in claim 1 wherein the amount of false twist imparted to the travelling assembly corresponds with a twist factor within the range 100 to 300.

9. A process as claimed in claim 8 wherein the twist factor is about 200.

10. A process as claimed in claim 1 wherein the fibers are animal hairs.

11. A process as claimed in claim 10 wherein the fibers are wool.

12. A process as claimed in claim 1 wherein the twist factor of the fiber assembly is increased following said stretching and while the stretch is being set.

13. Staple fibers having reduced diameters as a result of a stretching process wherein the process comprises treating a substantially untwisted traveling assembly of natural fibers to plasticize the natural fibers, twisting the treated traveling assembly to apply sufficient false twist to the assembly to substantially prevent drafting of the assembly during subsequent stretching, subsequently stretching the twisted assembly and setting the stretch;

wherein the false twist is present in the assembly during stretching and subsequent setting.

* * * * *